US009058724B2

(12) United States Patent
Adiraju et al.

(10) Patent No.: US 9,058,724 B2
(45) Date of Patent: Jun. 16, 2015

(54) CONTROLLING APPLICATION DATA IN WAGERING GAME SYSTEMS

(71) Applicant: WMS Gaming, Inc., Waukegan, IL (US)

(72) Inventors: Srinivyasa M. Adiraju, Vernon Hills, IL (US); Dale R. Buchholz, Palatine, IL (US); Mark B. Gagner, West Chicago, IL (US); Damon E. Gura, Chicago, IL (US); Mark C. Pace, Palatine, IL (US); Larry J. Pacey, Northbrook, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 14/220,980

(22) Filed: Mar. 20, 2014

(65) Prior Publication Data

US 2014/0206441 A1 Jul. 24, 2014

Related U.S. Application Data

(62) Division of application No. 13/123,454, filed as application No. PCT/US2009/060078 on Oct. 9, 2009, now Pat. No. 8,715,073.

(60) Provisional application No. 61/104,121, filed on Oct. 9, 2008.

(51) Int. Cl.
*G07F 17/32* (2006.01)

(52) U.S. Cl.
CPC ..... *G07F 17/3255* (2013.01); *G07F 17/323* (2013.01); *G07F 17/32* (2013.01); *G07F 17/3227* (2013.01)

(58) Field of Classification Search
CPC ..... G07F 17/3225; G07F 17/323; G07F 17/3232; G07F 17/3234; G07F 17/3239
USPC ..... 463/16
See application file for complete search history.

(56) References Cited

U.S. PATENT DOCUMENTS 7,025,674 B2 4/2006 Adams et al.
2005/0085300 A1 4/2005 Johnson (Continued)

FOREIGN PATENT DOCUMENTS

WO WO-2007120444 10/2007
WO WO-2010042775 4/2010

OTHER PUBLICATIONS

"AU Application No. 2009302257 Examination Report", Apr. 17, 2013 , 4 pages.

(Continued)

*Primary Examiner* — Corbett B Coburn
(74) *Attorney, Agent, or Firm* — DeLizio Law, PLLC

(57) ABSTRACT

A wagering game system and its operations are described herein. In embodiments, the operations can include obtaining data provided from a first application. In some examples, the first application is a wagering game application presented on a wagering game machine. The operations can also include determining a subscription level associated with a second application. The subscription level indicates access to the data from the first application. Further, the operations can also include, providing a service to the second application. In some examples, the service is one of a plurality of tiers of services that correspond to the subscription level. In some examples, the service has one of a plurality of degrees of access to the data from the first application according to the subscription level.

26 Claims, 8 Drawing Sheets

(56) References Cited

U.S. PATENT DOCUMENTS

| | | | |
|---|---|---|---|
| 2006/0148549 | A1 | 7/2006 | Walker et al. |
| 2008/0146342 | A1 | 6/2008 | Harvey et al. |
| 2011/0250955 | A1 | 10/2011 | Adiraju et al. |

OTHER PUBLICATIONS

"PCT Application No. PCT/US09/60078 International Preliminary Report on Patentability", Sep. 20, 2010 , 4 pages.
"PCT Application No. PCT/US09/60078 International Search Report", Nov. 30, 2009 , 11 pages.
"U.S. Appl. No. 13/123,454 Office Action", Aug. 23, 2013 , 9 pages.

426

| SUBSCRIPTION LEVEL | ACCESSIBLE INFORMATION | SERVICES PROVIDED |
|---|---|---|
| STANDARD | • WIN/LOSS RESULTS | • PROVIDE TARGETED ADVERTISEMENT BASED ON ACCESSIBLE INFORMATION |
| PREMIUM | • WIN/LOSS RESULTS<br>• REEL SYMBOL COMBINATIONS, AND<br>• GAME TYPE | • PROVIDE TARGETED ADVERTISEMENT BASED ON ACCESSIBLE INFORMATION |
| PARTNER | • ALL GAME SESSION STATISTICS<br>• ALL USER ACTIVITY INFO,<br>• PLAYER PREFERENCE DATA | • PROVIDE TARGETED ADVERTISEMENT BASED ON ACCESSIBLE INFORMATION<br>• SEND DATA REPORT TO MARKETING SERVER |

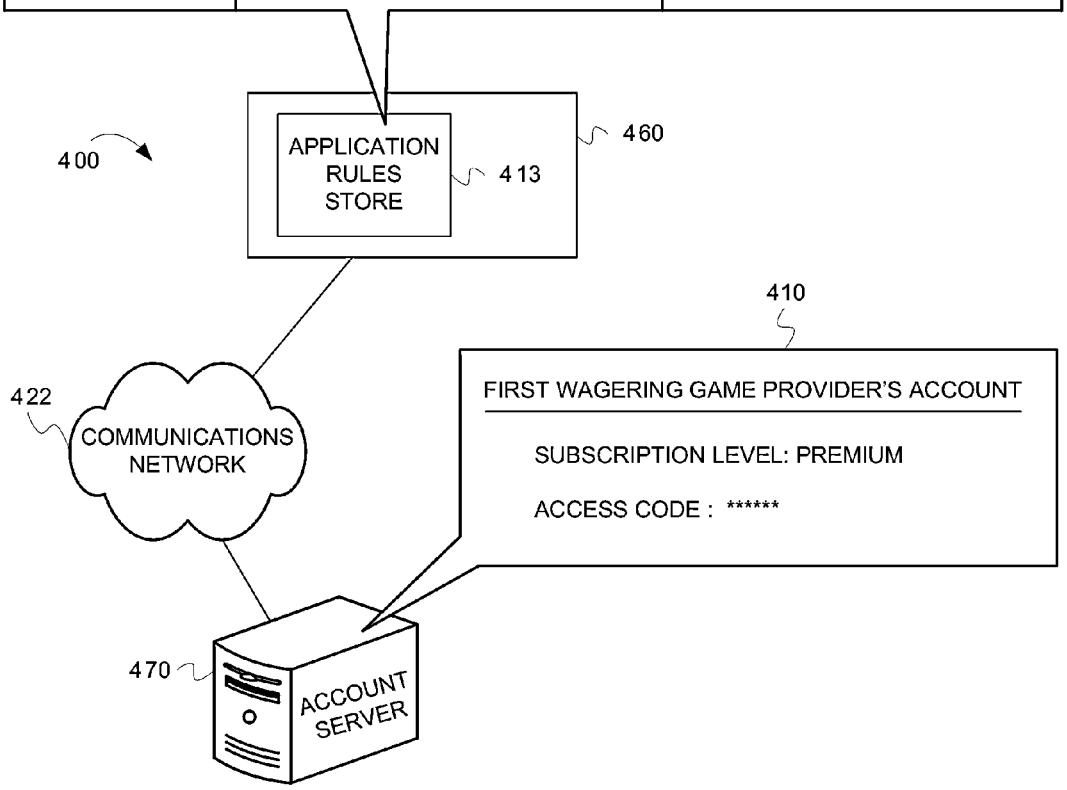

FIG. 4

CONTROLLING APPLICATION DATA IN WAGERING GAME SYSTEMS

RELATED APPLICATIONS

This application is a divisional application of, and claims priority benefit of, U.S. application Ser. No. 13/123,454 which is a National Stage Application of PCT/US09/60078 filed 9 Oct. 2009, which claims priority benefit of Provisional U.S. Application No. 61/104,121 filed 9 Oct. 2008. The Ser. No. 13/123,454 Application, the PCT/US09/60078 Application, and the 61/104,121 Application are incorporated by reference herein.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2014, WMS Gaming, Inc.

TECHNICAL FIELD

Embodiments of the inventive subject matter relate generally to wagering game systems and networks that, more particularly, control application data in wagering game systems.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. However, wagering game providers and wagering game machine manufacturers run into challenges with controlling and presenting data on wagering game machines, servers, and other devices, as the features and enhancements of new wagering games becomes more complex. Some wagering game machines can run multiple applications simultaneously, which may simultaneously need to present information on the wagering game machine, thus increasing the control and presentation complexities that game programmers and machine designers must deal with. Thus there is a continuing need for wagering game providers, wagering game machine manufacturers, and others, to continuously develop new games and applications that will attract frequent game play but also interoperate with other hardware and software on wagering game systems and networks.

BRIEF DESCRIPTION OF THE DRAWING(S)

Embodiments are illustrated in the Figures of the accompanying drawings in which:

FIG. 4 is an illustration of a wagering game system 400, according to some embodiments;

DESCRIPTION OF ILLUSTRATIVE EMBODIMENTS

This description of the embodiments is divided into five sections. The first section provides an introduction to embodiments. The second section describes example operating environments while the third section describes example operations performed by some embodiments. The fourth section describes additional example operating environments while the fifth section presents some general comments.

Introduction

This section provides an introduction to some embodiments.

As mentioned previously, a wagering game machine can run various applications simultaneously to process wagering games, financial transactions, advertising, etc. Many of those applications need to present information (e.g., content, messages, etc) on the wagering game machine. Sometimes, the applications need to present information simultaneously, thus presenting a challenge for programmers to design wagering game machines that can handle the complex timing and presentation needs of the applications. Further, various events can occur continuously during a wagering game session on the wagering game machine that can cause the presentation needs of the applications to change constantly. Thus interoperability needs between the applications are becoming more complex to program. Embodiments of the inventive subject matter, however, present solutions to many of those challenges. For example, FIG. 1 describes examples of determining and using application data provided by various applications to coordinate content presentation, on a wagering game machine, FIG. 3 describes examples of controlling presentation of content using messages from applications, and FIG. 5 describes examples of presenting wagering game content in stages and modifying the presentation according to player preference.

Figure 1:
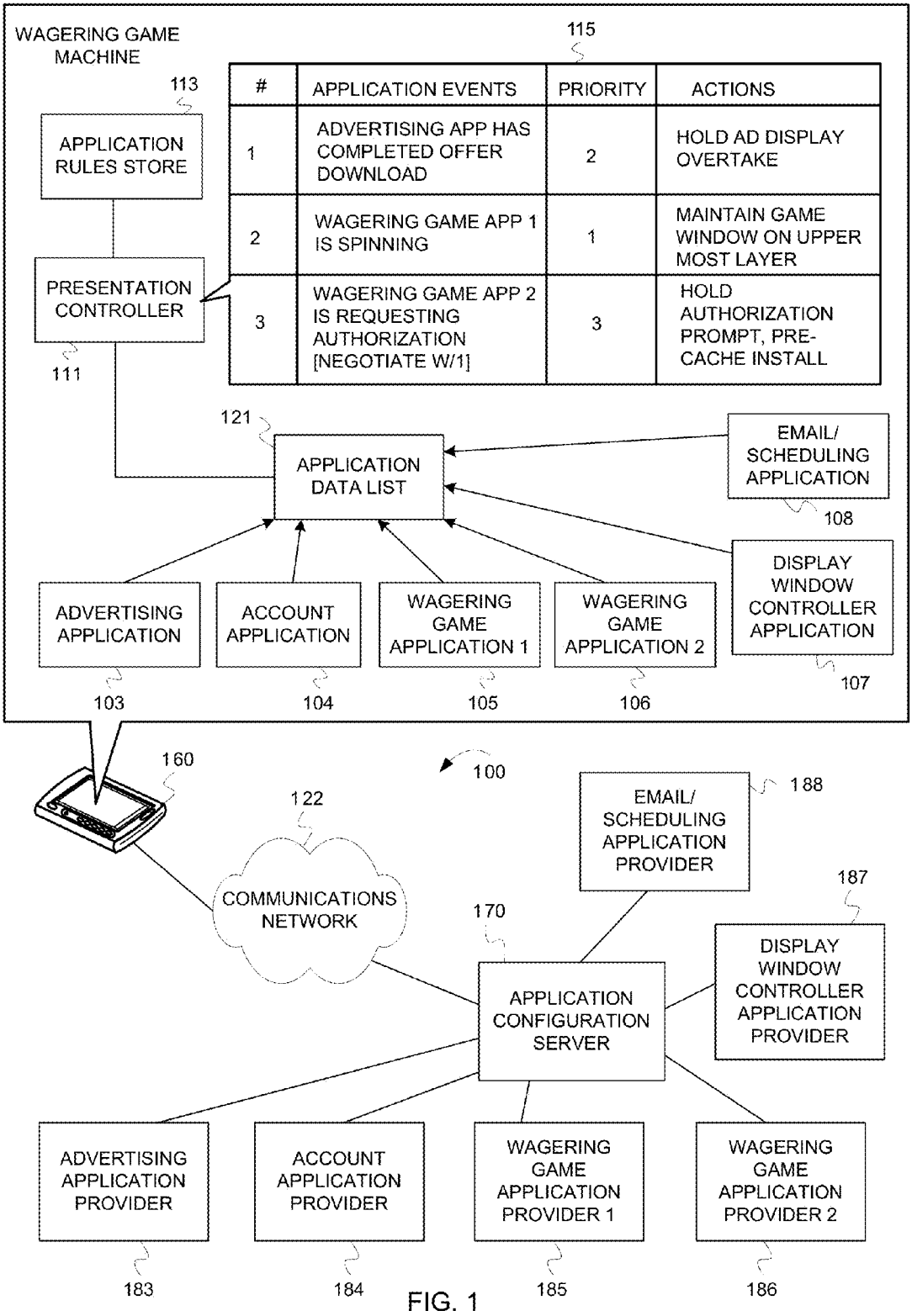
FIG. 1 is an illustration of determining and using application data provided by various applications to coordinate content presentation, according to some embodiments.

FIG. 1 is a conceptual diagram that illustrates an example of determining and using application data provided by various applications to coordinate content presentation, according to some embodiments. In FIG. 1, a wagering game system ("system") 100 includes a wagering game machine 160 that receives applications 103, 104, 105, 106, 107, 108 ("applications 103-108") from an application configuration server 170 via a communications network 122. The applications 103-

108 can be software designed for use on a wagering game machine 160. The application configuration server 170 can receive the applications 103-108 from various application providers 183, 184, 185, 186, 187, 188 ("application providers 183-188") via the communications network 122 (e.g., via a network download) and/or via other means (e.g., direct installation from disk). When the application configuration server 170 receives the applications 103-108, the application configuration server 170 can determine whether the applications 103-108 can generate application data in a proper format (e.g., whether the applications 103-108 can broadcast, publish, generate, or otherwise produce data that a presentation controller 111 can use to prioritize and present information on the wagering game machine 160 for the applications 103-108). If the applications 103-108 are not configured to generate the application data in the proper format, the application configuration server 160 can configure the application to provide the application data in a proper format. The application configuration server 170 can also receive application updates (e.g., updated versions of software) from the application providers 183-188. The application configuration server 170 can determine application rules to store on the wagering game machine 160, which the presentation controller 111 can use to coordinate the presentation of application data. In some embodiments, the application providers 183-188 can provide the application configuration server 170 with application control rules for anticipated application needs and/or interactions with the other possible applications 103-108 that may be on the wagering game machine 160. The application configuration server 170 can receive those rules and determine whether those rules have conflicts with each other according to one or more design protocols. In some embodiments, the application configuration server 170 can also generate control rules for application interactions based on the functionality and outcomes of possible events provided by the applications 103-108. For example, the application configuration server 170 can run simulations of scenarios where the applications 103-108 present (e.g., send, broadcast, etc.) various needs at differing times and in different processing combinations to determine control rules that the presentation controller 111 can use to most effectively control the priority and presentation of application data. The application configuration server 170 can also configure the applications 103-108 and the wagering game machine 160, using the application control rules, configuration protocols, etc., so that the applications 103-108 function properly on the wagering game machine 160. For example, the application configuration server 170 can install the applications 103-108 on the wagering game machine 160, and other wagering game machines, as part of a group, or batch, configuration. The application configuration server 170 can also write application rules to an application rules store 113 on the wagering game machine 160. All of the applications 103-108 can read from the application rules store 113 and write new rules to the application rules store 113. The wagering game machine 160 can also dynamically determine new rules, based on new combinations of events that occur on the wagering game machine 160 between the applications 103-108, and write the new rules to the application rules store 113. The wagering game machine 160 can also provide the new rules to the application configuration server 170 to configure other applications and other wagering game machines.

The wagering game machine 160 runs the applications 103-108 as requested or needed. As the applications 103-108 run, the applications 103-108 provide application data (e.g., publish the application data to the application data list 121, broadcast application data to each other, etc.). Application data can include states (application states, state of game play, instructions in queue, etc.), events (game outcomes, wager amounts, how much a machine/player has won, game play element configurations, game results, awards, bonus rounds, game history, etc.), properties, (e.g., window positions, level of communications, etc.), and other information (e.g., player data, metadata, account information, etc.). The applications 103-108 can listen to each other and use the information to generate messages that the presentation controller 111 can use to prioritize and present information. Further, the applications 103-108 can intercept messages from each other, which may trigger new messages, data, events, states, property changes, etc., amongst the applications 103-108. For example, the advertising application 103 can look for application data produced by wagering game applications 105, 106, such as occurrences of a slot reel combination. Based on the slot reel combination, advertising application 103 can present a specific advertisement. The presentation controller 111 can receive messages from the advertising application 103 to present the advertisement and prioritize the presentation of the advertisement (e.g., place the advertisement into a priority order or list 115). In another example, an accounting application 105 can provide financial information about wagering amounts. In return other applications can use the financial information (e.g., a responsible gaming application can receive the financial information, which triggers a reminder by the responsible gaming application for the player account to stop gambling). The system 100 can also require a security exchange or authentication before allowing the data to be received by other applications. For instance, in the case of security sensitive data, like financial data, the system 100 can require that applications, which want to listen to and/or receive the financial information, authenticate themselves with a sentinel service that runs on the client, server, or other device. The applications 103-108 and the presentation controller 111 can also receive application data from other applications (e.g., network applications, applications on personal computing devices connected to the communications network 122, etc.) and/or devices (e.g., other wagering game machines on the communications network 122) accessible to the wagering game machine 160. In some embodiments, the system 100 can also receive other data (e.g., wagering game machine specific data, player specific data, network application specific content, etc.) from the wagering game machine 160, the application configuration server 170, an account server, a wagering game server, or any other server or device on the network. The applications 103-108 can use that information to determine actions, generate application data, etc.

The applications 103-108 can contain individual rule sets and/or rule controllers for each application that controls how to handle application data under known and foreseeable scenarios or combinations of events, states, etc. The system can also include a configuration tool installed on the application configuration server 170 to configure the rule sets for each of the applications 103-108. Thus, the system 100 can know ahead of time how to publication application data. The system 100 can also be configured to dynamically generate new rules and/or reconfigure itself to adapt to new rules. For instance, the system 100 can recognize new scenarios of previously unknown events and come up with new rules for handling the new scenario. The system 100 can dynamically add the new rules to the application rules store 113 and/or to individual rules stores for each application. If the scenarios are potentially repeatable by other wagering game machines, the system 100 can provide the application configuration server 170 with the new rules for those scenarios. The application configuration server 170 can configure the applications for the new rules. The application configuration server 170 can then push the updated rules to the wagering game machine 160 and other wagering game machines on the communications network 122. The system 100 can also provide the new scenarios to the application providers so that the application providers can update the software to respond to the new scenarios with new rules/functionalities and other related scenarios. The wagering game machine 160, the application configuration server 170, and any other network device that runs configurable applications that can provide application data, can include a configuration controller (e.g., see FIG. 2) that configures and reconfigures applications for the interoperability described above. The applications 103-108, and other applications not shown, may be referred to herein as "smart", "dynamic", "reactive", etc. to emphasize the ability for an example application to provide application data, react to application data from other applications, reconfigure itself based on new application data, etc. Further, although FIG. 1, illustrates the presentation controller 111, the applications rules store 113, the application data list 121 and the applications 103-108 on the wagering game machine 160, any of those components can be on other devices, such as one or more servers (e.g., the application configuration server 170, the wagering game server 250 in FIG. 2, a content server, an account server, etc.). The server(s) can track the application data from the applications 103-108 on the wagering game machine 160, and/or on other wagering game machines connected to the communications network 122, and generate presentation and priority instructions based on the application data. In other embodiments, the server(s) can also have applications that provide application data for the wagering game machine 160 to use and/or to interact with application data generated by the applications 103-108.

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
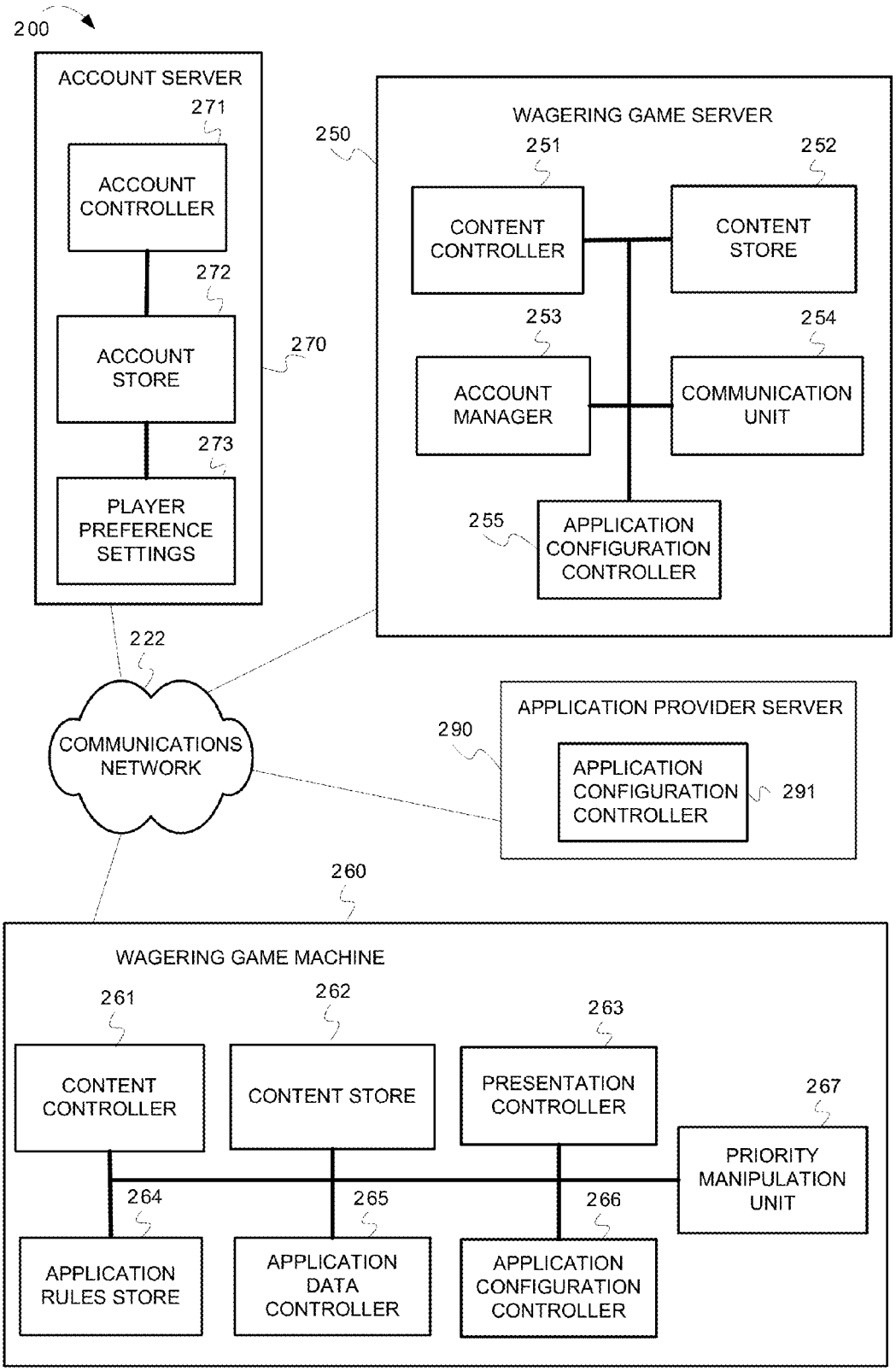
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networks. The account server 270 can store and track player information, such as identifying information (e.g., avatars, screen name, account identification numbers, etc.) or other information like financial account information, social contact information, etc. The account server 270 can contain accounts for social contacts referenced by the player account. The account server 270 can also provide auditing capabilities, according to regulatory rules, and track the performance of players, machines, and servers. The account server 270 can include an account controller 271 configured to control information for a player's account. The account server 270 can also include an account store 272 configured to store information for the player's account. The account server 270 can also include a player preference settings 273 configured to store player preferences for presenting and prioritizing content during a wagering game session.

The wagering game system architecture 200 can also include a wagering game server 250 configured to control wagering game content, provide random numbers, and communicate wagering game information, account information, and other information, to and from a wagering game machine 260. The wagering game server 250 can include a content controller 251 configured to manage and control content for the presentation of content on the wagering game machine 260. For example, the content controller 251 can generate game results (e.g., win/loss values), including win amounts, for games played on the wagering game machine 260. The content controller 251 can communicate the game results to the wagering game machine 260. The content controller 251 can also generate random numbers and provide them to the wagering game machine 260 so that the wagering game machine 260 can generate game results. The wagering game server 250 can also include a content store 252 configured to contain content to present on the wagering game machine 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the wagering game machine 260 and to communicate with other systems, devices and networks. The wagering game server 250 can also include an application configuration controller 255 configured to configure the wagering game machine 260 with applications that can provide data regarding their presentation needs.

In some embodiments, the wagering game system architecture 200 can also include an application provider server 290 configured to provide applications to the wagering game server 250 and the wagering game machine 260. The application provider server 290 can also have an application configuration controller 291 configured to configure applications to generate, receive, and provide application data and respond to application data from other applications. The application configuration controller 291 can also generate application control rules and include those control rules with the applications.

The wagering game system architecture 200 can also include the wagering game machine 260 configured to present wagering games and receive and transmit information to control application data in wagering game systems. The wagering game machine 260 can include a content controller 261 configured to manage and control content and presentation of content on the wagering game machine 260. The wagering game machine 260 can also include a content store 262 configured to contain content to present on the wagering game machine 260. The wagering game machine 260 can also include a presentation controller 263 configured to present content on a wagering game machine according to application data, broadcasted messages, etc. from smart applications and priority rules. The wagering game machine 260 can also include an application rules store 264 configured to store rules regarding the presentation and prioritization of content on the wagering game machine 260. The wagering game machine 260 can also include an application data controller 265 configured to track application data from smart applications on the wagering game machine 260. The application data controller 265 can publish the application data on an application data list. In some embodiments, the smart applications can read the application data directly from each other using the application data controller 265. The wagering game machine 260 can also include an application configuration controller 266 configured to dynamically recognize new combinations of events, properties, and/or other information and needs from smart applications and generate new application control rules. The application configuration controller 266 can also provide the wagering game server 260 with the new control rules. The application configuration controller 255 on the wagering game server 250 can then use the new rules to configure applications on other wagering game machines. The wagering game machine 260 can also include a priority manipulation unit 267 configured to present priority and presentation information about content and receive information from a player account regarding manipulating the priority and/or presentation for the content.

Each component shown in the wagering game system architecture 200 is shown as a separate and distinct element connected via a communications network 222. However, some functions performed by one component could be performed by other components. For example, the wagering game server 250 can also be configured to perform functions of the presentation controller 263, the application rules store 264, the application data controller 265, the application configuration controller 266, the priority manipulation unit 267, and other network elements and/or system devices. Furthermore, the components shown may all be contained in one device, but some, or all, may be included in, or performed by multiple devices, as in the configurations shown in FIG. 2 or other configurations not shown (e.g., each of the components can be split into a plurality of servers). Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
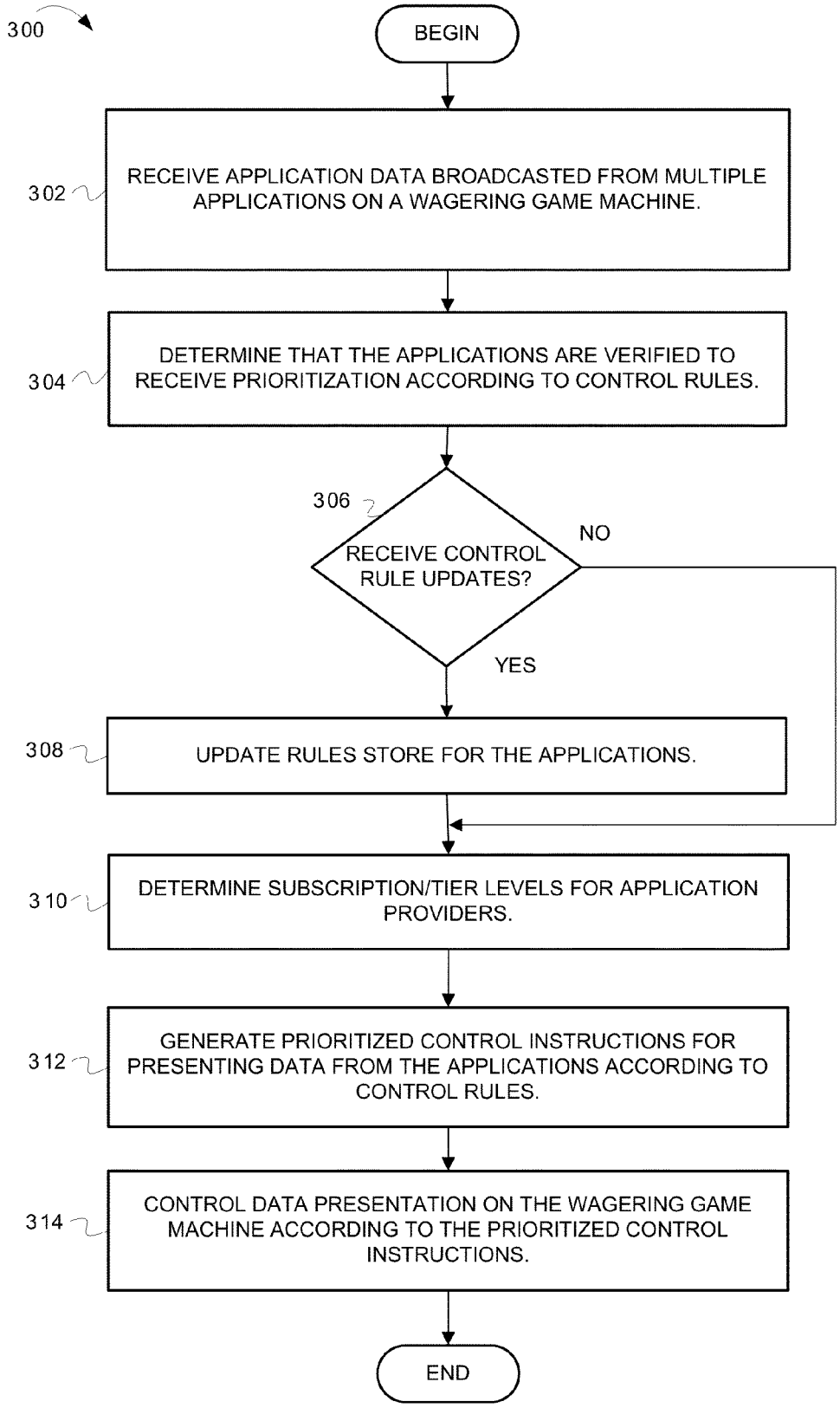
FIG. 3 is a flow diagram 300 illustrating controlling presentation of content using application data provided by applications on a wagering game machine, according to some embodiments.

FIG. 3 is a flow diagram ("flow") 300 illustrating controlling presentation of content using application data provided by applications on a wagering game machine, according to some embodiments. FIGS. 1 and 4 are conceptual diagrams that help illustrate the flow of FIG. 3, according to some embodiments. This description will present FIG. 3 in concert with FIGS. 1 and 4. In FIG. 3, the flow 300 begins at processing block 302, where a wagering game system ("system") receives application data provided by multiple applications on a wagering game machine. The application data indicates events, states, properties, etc., expressed and/or needed by the multiple applications to present data (e.g., content, information, etc.) on the wagering game machine. The applications can include wagering games, resident applications, other local applications, net widgets, etc. (e.g., a watcher application for watching player's bets, a transparent network application that is watching for network activity, third party applications, network applications, etc.). In some embodiments, the wagering game machine can run the applications. The system receives the application data and can use it to negotiate the presentation of content (e.g., negotiate the screen locations for content) based on the application data and rule sets. For example, in FIG. 1, each of the applications 103-108 can be registered on the application data list 121. The application data list 121 stores the application data from the applications 103-108. For example, the applications 103-108 can provide application data that indicates properties and states related to screen real-estate that the application is currently using or that the application desires to use. The presentation controller 111 can use rule sets form the application rules store 113 to negotiate the screen real-estate based on the importance of the content provided by the applications. The presentation controller 111 generates control instructions and prioritizes them in the priority order list 115. The presentation controller 111 can also receive and use other information from the application data (e.g., speaker usage, processor thread usage, memory usage, etc.). The system 100 can verify that the applications 103-108 can provide the appropriate application data that the rule set(s) need to perform negotiations. Consequently, the system can utilize applications from various providers, regardless of the manufacturer, as long as the applications are capable of proving the proper information]. In some embodiments, the applications can generate messages that contain smart functionality where metadata controls the presentation and timing of the presentation of data. For instance, an advertising application can send a redemption offer including a message to present the offer on a wagering game machine. However, the offer may include metadata that suppresses the message from presenting itself on-screen until the wagering game machine is not in midst of a wager. In another example, a message could contain metadata that triggers the display of content (e.g., the presentation of the content awaits some type of gaming outcome before popping up on-screen). In some embodiments, the system can receive messages for non-gaming content. The applications can be related to both wagering game content (e.g., the wagering game applications 105, 106), non-wagering game content (e.g., the advertising application 103, email/scheduling application 108) or both the (e.g., account application 104, which may transact information on wager amounts and financials related to a wagering game but also present messages and content related to social networks, casino events, etc.). Other non-gaming content and/or messages that may be provided by applications on a wagering game machine include, but are not limited to, chat content, email, scheduling, web browsing content, non-wagering games, retail content, etc. Furthermore, some system level applications (e.g., the display window controller application 107) can provide messages that tell the gaming device to pause while a wagering game displays system content in a separate window or takes over all display devices on the gaming screen. In some embodiments, the system can query a wagering game machine and/or network configurations, parameters, etc. to determine system level needs and/or to anticipate other needs (e.g., waiting for people to log in to a game). In some embodiments, the system can detect changes of events by applications (e.g., when a player does something new—starts a new game, when a new message comes in, when a player hits a jackpot or bonus game, etc.). For example, a wagering game player ("player") may initiate an action that triggers an event for a third party to perform something (send a message, provide a reward, etc.). The system, therefore, can detect the event change initiated by the player and accordingly adjust the presentation and/or priority of resulting messages and/or content. In some embodiments, the system can determine locations of the wagering game machine and origins of the applications and services. In some embodiments, the system can provide controls for player accounts to configure where to place windows for the different applications.

The flow 300 continues at processing block 304, where the system determines applications are verified to receive prioritization according to control rules. In some embodiments, the system can require security and/or go through a verification process for the applications to make sure that applications are verified to provide rules, run rules, etc. The verification process may include determining account information for application providers. FIG. 4 illustrates an example. In FIG. 4, a wagering game system ("system") 400 includes a wagering game machine 460 connected to an account server 470 via a communications network 422. The account server 470 can include account information 410 related to an account owned by an application provider. The wagering game machine can access the account to determine whether an application is authorized to function on the wagering game machine 460. The wagering game machine 460 may include access codes, passwords, shared keys, etc., that match up to information in the account. The wagering game machine 460 can verify the codes, passwords, shared keys, etc., at initiation, boot-up, etc., to ensure that the application is secure.

The flow 300 continues at processing block 306, where the system determines whether there are control rule updates. In some embodiments, application providers can provide updates to their applications which may include updates to control rules. In other embodiments, configuration servers, wagering game machines, or other devices configured to update control rules, can provide control rule updates. If there are updated and/or additional control rules, smart applications can generate new or updated application data, which the system, for example, using the application data controller 265, can recognize and publish to an application data list (e.g., the application data list 121). In some embodiments, the wagering game applications can also submit new rules. If there are new and/or updated rules, the flow 300 continues at processing block 308, where the system updates rules store for the applications.

The flow 300 continues at processing block 310, where the system determines subscription and/or tiered levels for application providers. In some embodiments, the system can determine tiers of services that allow certain things to happen based on a subscription level (e.g., one subscription level can watch for reels that spin, where another subscription level watches what the reels do). For example, in FIG. 4, the wagering game machine 460 can refer to a subscription level chart 426 that describes differences in access to information and services provided based on differing subscription levels. The subscription level chart 426 can be stored in an application rules store 413, in an external database, or in other locations. In some embodiments, the subscriptions levels apply to information and services that the system 400 can provide to the applications. Based on the subscription levels, the system 400 may allow only certain data to be published, certain activities to occur, certain application to access data, etc. In other embodiments, the subscription levels can apply to what player accounts can access and perform. Player accounts can also subscribe and/or authorize another player's information (e.g., a player watches another player's gaming activity so that the player can bet along with the other player's gaming activity). The wagering game machine 460, therefore, can be configured to access data published on another player's wagering game machine, computer, or other device capable of playing wagering games. In other embodiments, the system can determine if a number of wagering game machines are ready to perform an action (e.g., participate in a community game). As a result, the wagering game machines can be spread across a network (e.g., a mobile wagering game machine, a computer, etc.), and applications on the wagering game machine 460 can respond to the application data of the community game, can change priority.

The flow 300 continues at processing block 312, where the system generates prioritized control instructions for presenting data from the applications according to control rules. For example, the application data controller 265, in FIG. 2, can organize application data and use the application data to generate prioritized control instructions. The application data controller 265, therefore, can function like a director for control rules, application data, and control instructions. The system can include network/server level application data controllers that control application data and control rules for network applications and client level application data controllers to control application data and control rules for client applications. Client level application data controllers can receive the network information and use some of it (i.e., whatever it needs) to prioritize client application actions and needs with network applications actions and needs. The client level application data controllers, however, can be independent of network level application data controllers so that they can function, without network connectivity, based on their local control rules. In some embodiments, the system can utilize the control rules to determine a balance between a degree of interference with the gaming experience and the importance of the application data. In some embodiments, the system can negotiate control instructions between applications. For example, the system can negotiate the presentation of content between applications based on their current and intended, states, events, properties etc.

The flow 300 continues at processing block 314, where the system controls data presentation on the wagering game machine according to the prioritized control instructions. Based on priority, an application can change the way it was going to present data. For example, an application may provide application data indicating that it wants to display a first content on a full screen display of the wagering game machine. However, the system prioritizes the application's need to display the first content by assigning the application's request with a low priority, based on application data of greater importance from other applications that need to display higher priority content in a portion of the wagering game machine display. The application can receive its priority and, based on its assigned priority, decide to change its application data to negotiate a higher priority. For example, the application may decide that it could display the first content in a smaller portion of the screen, instead of a full screen, to expedite the display of the first content. The application can, thus, present new application data that requests to present the first content in a smaller portion of the wagering game display. The system could receive the changed application data and determine that the higher priority content can be displayed simultaneously with the first content, as a result, assign a higher presentation priority to the application because the application no longer requires a full screen display. The system can, therefore, present the first content sooner than it would have had the application not changed the application data.

Figure 5:
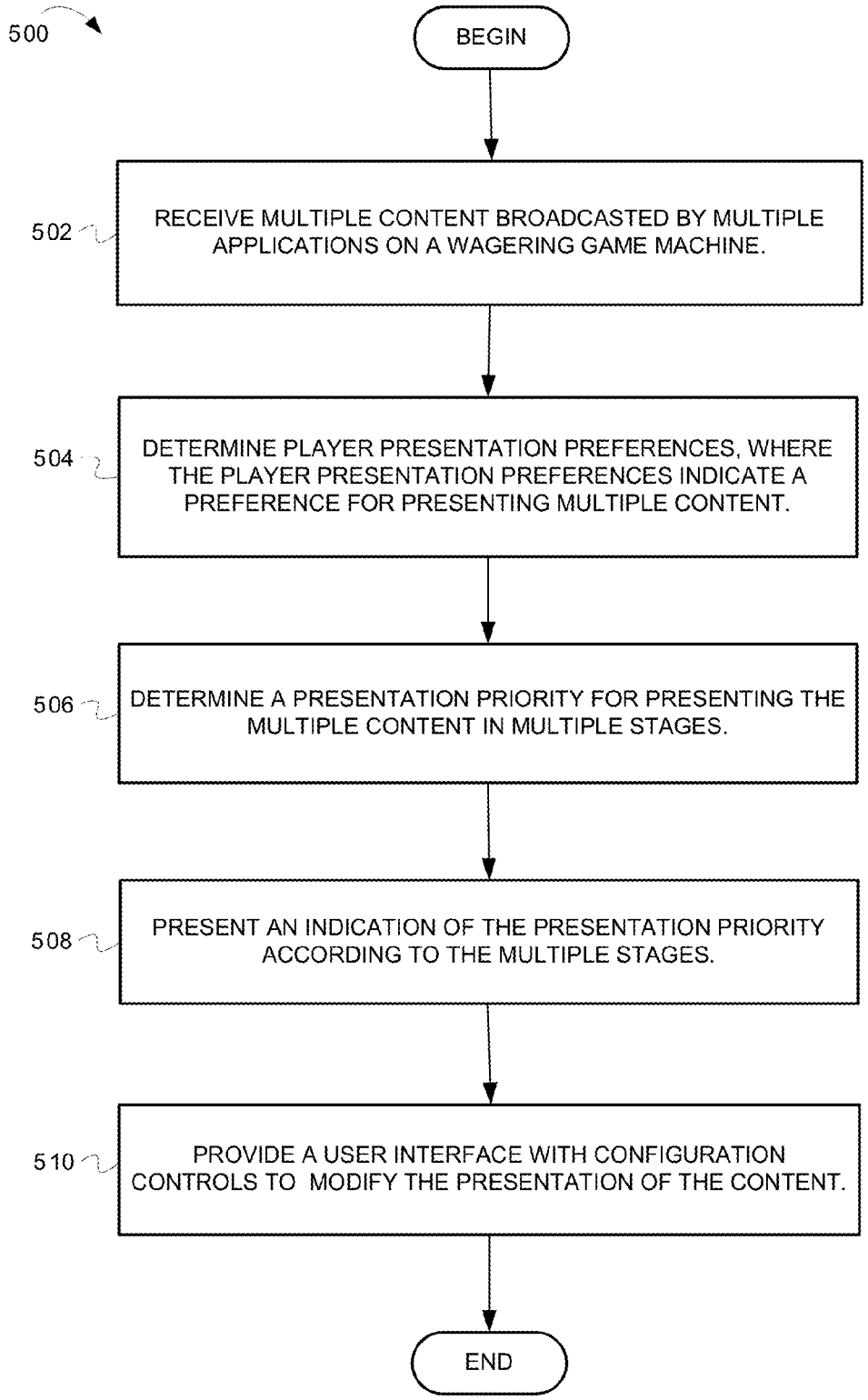
FIG. 5 is a flow diagram 500 illustrating presenting wagering game content in stages and modifying the presentation to player preferences, according to some embodiments.
Figure 6:
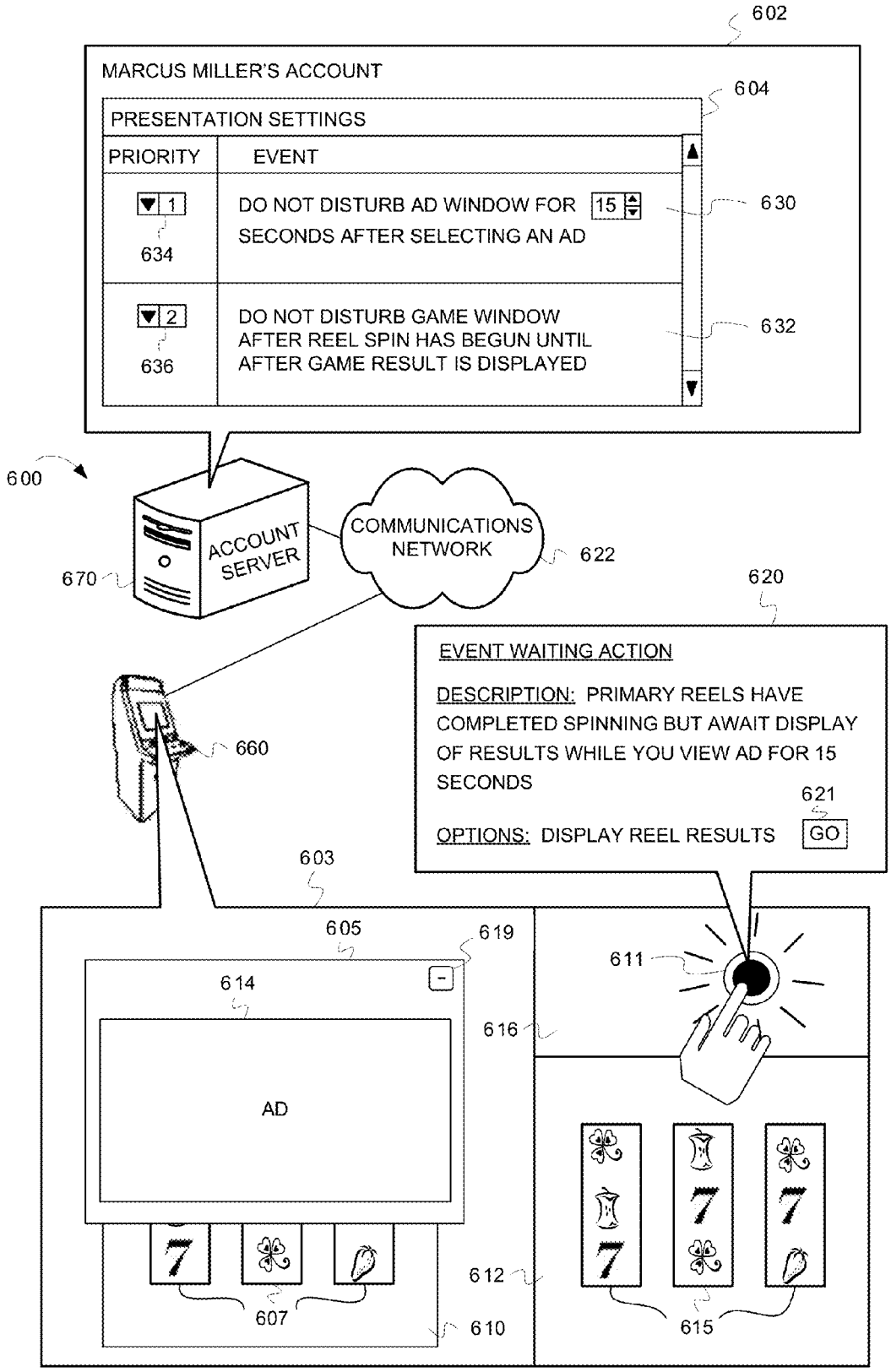
FIG. 6 is an illustration of a wagering game system 600, according to some embodiments.

FIG. 5 is a flow diagram ("flow") 500 illustrating presenting wagering game content in stages and modifying the presentation to player preferences, according to some embodiments. FIG. 6 is a conceptual diagram that helps illustrate the flow of FIG. 5, according to some embodiments. This description will present FIG. 5 in concert with FIG. 6. In FIG. 5, the flow 500 begins at processing block 502, where a wagering game system ("system") receives multiple content provided by multiple applications on a wagering game machine. For example, the system can determine a first content from a first application on the wagering game machine and a second content from a second application on a wagering game machine. The wagering game machine is configured to present the first wagering game content and the second wagering game content in one or more windows on the wagering game machine display. FIG. 6 illustrates an example. In FIG. 6, a wagering game system ("system") 600 includes a wagering game machine 660 connected to an account server 670 via a communications network 622. The wagering game machine 660 presents a display 603 that includes various windows 605, 610, 612, and 616, that present various types of content and information (e.g., an advertisement window 605, a primary game window 610, a secondary game window 612, and a priority control window 616). The wagering game machine 660 is configured to present wagering game content from a first wagering game application in the primary game window 610 (e.g., the first wagering game application presents a first wagering game on reels 607 in the primary game window 610). The wagering game machine 660 is also configured to present wagering game content from a second wagering game application in the secondary game window 612 (e.g., the second wagering game application presents a second wagering game on reels 615 in the secondary game window 612). Further, the wagering game machine 660 is configured to present content from other applications in other windows, such as an advertising application that provides advertisements to the advertisement window 605 (e.g., the advertising application presents an advertisement 614 in the advertisement window 605). The various applications can provide information regarding their application data as described further above. For example, a player may be using the wagering game machine 660 to play the first wagering game in the primary game window 610. The player may initiate a spin of the reels 607. While the reels 607 are spinning, the player may be distracted by an advertisement animation within the advertisement 614 and may select a control button 619 to expand the advertisement window 605. The advertisement application provides application data indicating that it needs to present an expansion of the advertisement window 605. The flow 500 continues below describing how the wagering game machine 660 can consult control rules and player preferences indicated in a player account to determine that the advertisement window 605 should expand to cover the then spinning the reels 607.

The flow 500 continues at processing block 504, where the system determines player presentation preferences. The player presentation preferences can indicate a preference for presenting multiple content. For example, the system 600 presents a player account interface 602 that includes presentation preferences in a presentation priority settings 604. The presentation priority settings 604 can indicate a priority of presentation for certain types of content, for events that trigger the presentation of content, etc. In some embodiments, the presentation priority settings 604 can allow a player account to prioritize the priority of content by indicating events whose presentation should not be disturbed. The presentation priority settings 604, for example, includes a first setting 630, for a first event, and, a priority control 634 to set a priority for the first event described in the first setting 630. The first event relates to selection of an advertisement window such as the advertisement window 605. When the advertisement window 605 is selected, the first setting 630 indicates that other content or other events that affect content in other windows, other than the advertisement window 605, have a lower priority than the display of the advertisement in the advertisement window 605. The presentation priority settings 604 also includes a second setting 632, for a second event, and, a priority control 636 to set a priority for the second event described in the second setting 632. A second event described in the second setting 632 relates to the presentation of active game content in either of the primary game window 610 or the secondary game window 612. Specifically, the priority control 636 indicates that when either the reels 607 or the reels 615 begin spinning, then the respective windows (e.g., the primary game window 610 and the secondary game window 612) should not be disturbed by any other event except for the first event described in the first setting 630. However, the first setting 630 can also include an expiration period whereby the priority expires. For example, the first setting 630 indicates that, after being selected, the presentation of the advertisement window 605 should be undisturbed by other content, application data, priority control instructions, etc. for 15 seconds. Thus, if the primary game is spinning the reels 607 within the primary game window 610, but during that spinning period, the player selects the control button 619 on the advertisement window 605 to expand the view of the advertisement 614, the system 600 knows that a presentation of the advertisement 614 has priority over the presentation of the spinning reels 607 and thus expands the advertisement window 605. The advertisement window 605 may cover a portion of the reels 607 while it is being viewed by the player account. However, the first setting 630 indicated that the advertisement window only holds priority for 15 seconds. During those 15 seconds, the primary wagering game may continue spinning the reels 607. However, the system 600 still maintains the advertisement window 605 as an upper display layer so that it continues to cover the reels 607 during the 15 seconds. After the 15 seconds, however, the spinning reels may then take highest priority, and cause the advertisement window 605 to automatically collapse. If during the 15 seconds, the reels 607 stop spinning and want to present a wagering game result, the system 600 can look for a player preference that indicates a priority for displaying wagering game results. If there is no player preference, the system 600 can rely on presentation rules (e.g., if a game result is a win, the system 600 may enforce a display of the win as a higher priority than events indicated in the presentation priority settings 604, however, if the wagering game result is a loss, the system 600 may honor other events indicated in the presentation priority settings 604 as being higher priority than the game result display.).

The flow 500 continues at processing block 506, where the system determines a presentation priority for presenting the multiple content in multiple stages. For example, in FIG. 6, the system can determine, using the presentation preferences and control rules, that the content and/or events indicated in the first setting 630 should be presented before the content and/or events indicated in the second setting 632, according to a priority order (e.g., the advertisement window 605 is presented first, before the presentation of spinning reels 607).

The system 600, therefore, generates prioritized control instructions, for presenting the advertisement window 605 first in time and/or with greater prominence than the spinning reels 607.

The flow 500 continues at processing block 508, where the system presents an indication of the presentation priority according to the multiple stages. In some embodiments, the system can present an indicator on a display (e.g., in a window of the wagering game machine, on a peripheral devices, etc.) to indicate the priority order. For example, in FIG. 6, the priority control window 616 includes an indicator 611 that indicates that various events occur, each having a set priority for presentation. In some embodiments, the priority control window 616 can include a list of events and their order of presentation. In some embodiments, the indicator 611 can be selectable, such that when a player account selects the indicator (e.g., via touch), a presentation queue 620, which indicates items (e.g., content, events, messages, etc.) that are awaiting presentation according to the priority order.

The flow 500 continues at processing block 510, where the system provides a user interface with configuration controls to modify the presentation of the content. The configuration controls can rearrange the presentation order of the multiple stages. For example, in FIG. 6, the system 600 can first present the advertisement 614 in the advertisement window 605, according to the first setting 630. Simultaneously, the system 600 can determine that the reels 607 have completed spinning and are ready to display a wagering game result, according to the event indicated in the second setting. However, because the advertisement window 605 relates to a setting with a higher priority, the advertisement window may be fixed in its position for 15 seconds even though the wagering game result may be ready to be displayed on the reels 607 and displayed without being obstructed by the advertisement window 605. Consequently, while the advertisement window 605 holds the highest prominence (e.g., the advertisement window 605 is above all other windows), the indicator 611 presents an indication (e.g., a flashing light, a sound, etc.) that another event is awaiting its turn to present itself or otherwise take a position of prominence on the display 603. Specifically, the priority control window 616 presents the presentation queue 620 which indicates that the second event, the wagering game result, for the reels 607, is ready, but is waiting for the advertisement window 605 to meet its time requirement of 15 seconds set in the first setting 630. However, the presentation queue 620 also can include controls, such as an activation button 621, which can override the 15 second time limit set in the first setting 630 and force the primary game window 610 to immediately have highest priority, thus minimizing the advertisement window 605 and displaying the reels 607 in their entirety, along with any other messages indicating a wagering game win, loss, etc. In some embodiments, the presentation queue 620 can present controls to modify the presentation of multiple content related to multiple events (e.g., rearrange the order, cancel some items, change the way items are displayed, modify the location of displayed items, etc.). In some embodiments, the system 600 can build in rules restricting player's use, preventing the manual manipulation of priority order for certain types of content (e.g., reminders, warnings, errors, etc.).

Additional Example Operating Environments

This section describes example operating environments, systems and networks, and presents structural aspects of some embodiments.

Wagering Game Machine Architecture

Figure 7:
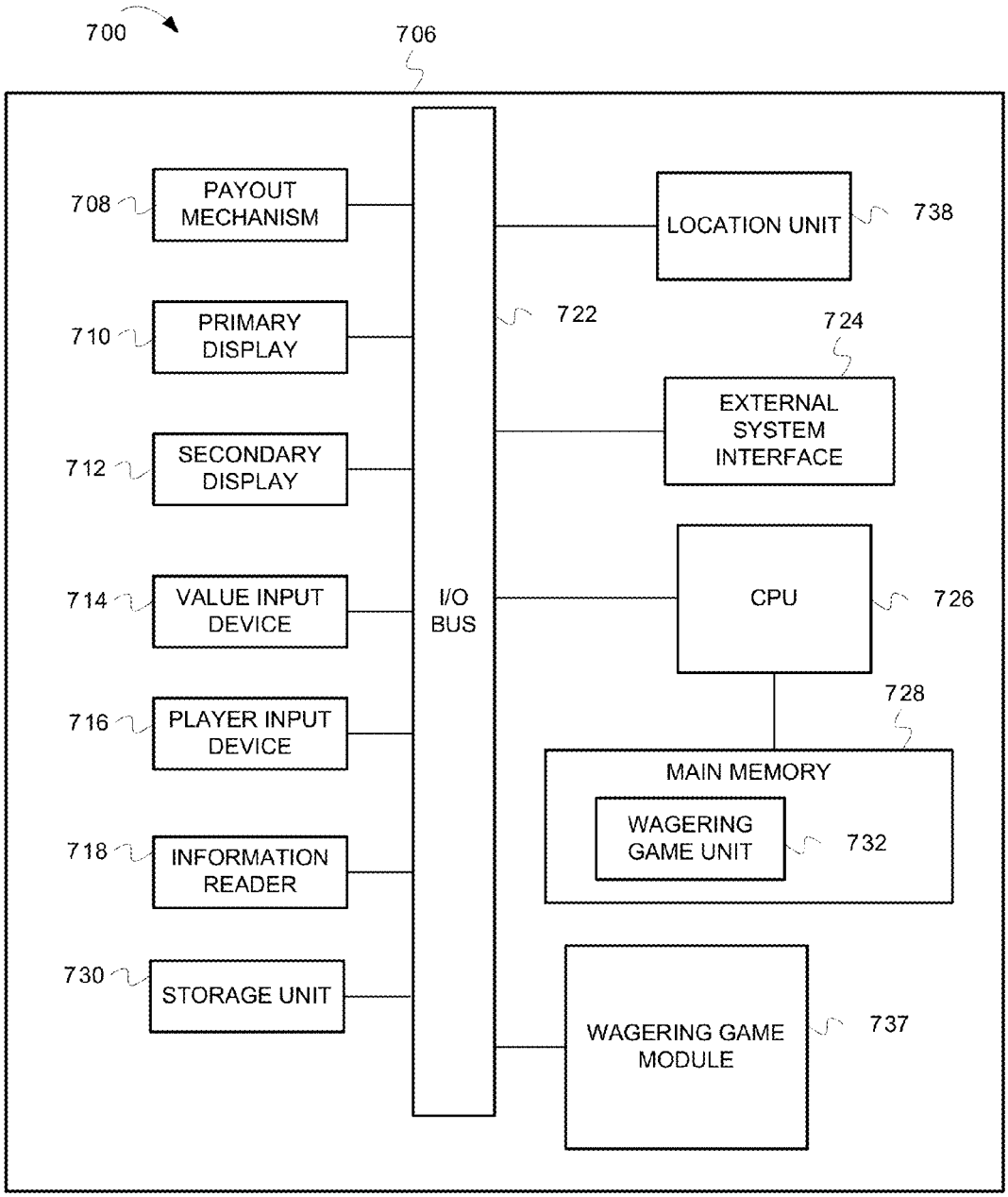
FIG. 7 is an illustration of a wagering game machine architecture 700, according to some embodiments.

FIG. 7 is a conceptual diagram that illustrates an example of a wagering game machine architecture 700, according to some embodiments. In FIG. 7, the wagering game machine architecture 700 includes a wagering game machine 706, which includes a central processing unit (CPU) 726 connected to main memory 728. The CPU 726 can include any suitable processor, such as an Intel® Pentium processor, Intel® Core 2 Duo processor, AMD Opteron™ processor, or UltraSPARC processor. The main memory 728 includes a wagering game unit 732. In some embodiments, the wagering game unit 732 can present wagering games, such as video poker, video black jack, video slots, video lottery, reel slots, etc., in whole or part.

The CPU 726 is also connected to an input/output ("I/O") bus 722, which can include any suitable bus technologies, such as an AGTL+ frontside bus and a PCI backside bus. The I/O bus 722 is connected to a payout mechanism 708, primary display 710, secondary display 712, value input device 714, player input device 716, information reader 718, and storage unit 730. The player input device 716 can include the value input device 714 to the extent the player input device 716 is used to place wagers. The I/O bus 722 is also connected to an external system interface 724, which is connected to external systems (e.g., wagering game networks). The external system interface 724 can include logic for exchanging information over wired and wireless networks (e.g., 802.11g transceiver, Bluetooth transceiver, Ethernet transceiver, etc.)

The I/O bus 722 is also connected to a location unit 738. The location unit 738 can create player information that indicates the wagering game machine's location/movements in a casino. In some embodiments, the location unit 738 includes a global positioning system (GPS) receiver that can determine the wagering game machine's location using GPS satellites. In other embodiments, the location unit 738 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 7, in some embodiments, the location unit 738 is not connected to the I/O bus 722.

In some embodiments, the wagering game machine 706 can include additional peripheral devices and/or more than one of each component shown in FIG. 7. For example, in some embodiments, the wagering game machine 706 can include multiple external system interfaces 724 and/or multiple CPUs 726. In some embodiments, any of the components can be integrated or subdivided.

In some embodiments, the wagering game machine 706 includes a wagering game module 737. The wagering game module 737 can process communications, commands, or other information, where the processing can control application data in wagering game systems.

Furthermore, any component of the wagering game machine 706 can include hardware, firmware, and/or machine-readable media including instructions for performing the operations described herein.

Mobile Wagering Game Machine

Figure 8:
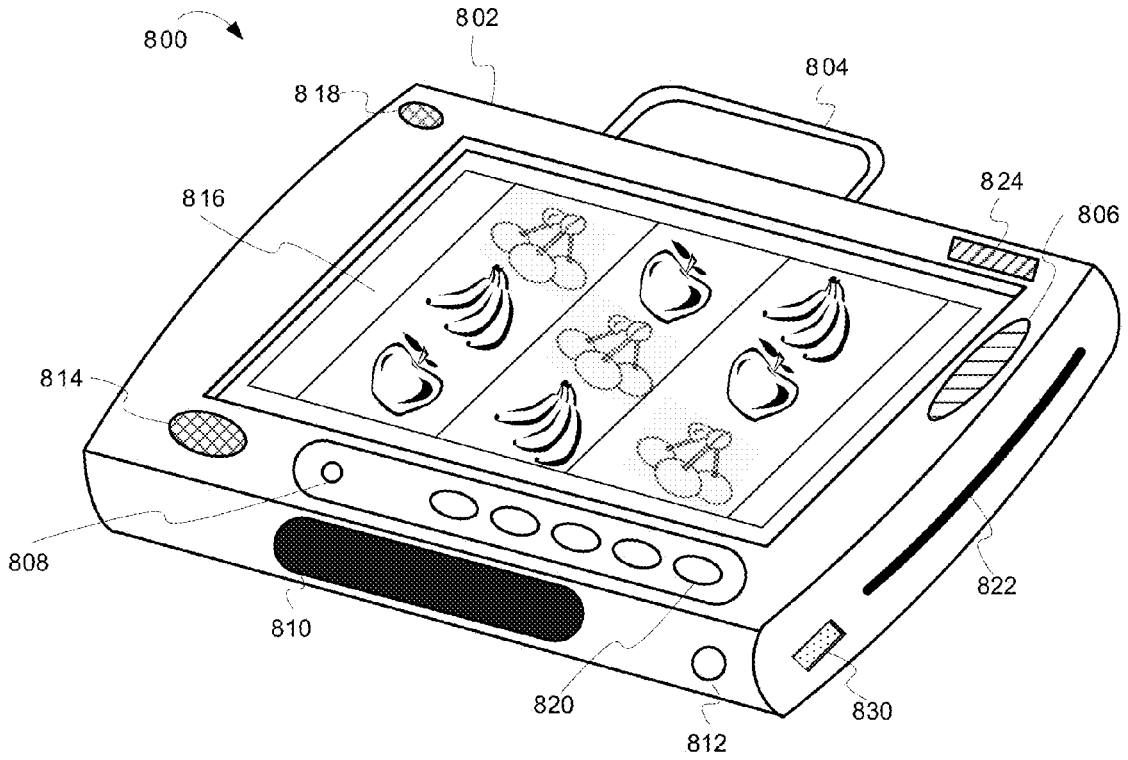
FIG. 8 is an illustration of a mobile wagering game machine 800, according to some embodiments.

FIG. 8 is a conceptual diagram that illustrates an example of a mobile wagering game machine 800, according to some embodiments. In FIG. 8, the mobile wagering game machine 800 includes a housing 802 for containing internal hardware and/or software such as that described above vis-à-vis FIG. 7. In some embodiments, the housing has a form factor similar to a tablet PC, while other embodiments have different form factors. For example, the mobile wagering game machine 800 can exhibit smaller form factors, similar to those associated with personal digital assistants. In some embodiments, a handle 804 is attached to the housing 802. Additionally, the housing can store a foldout stand 810, which can hold the mobile wagering game machine 800 upright or semi-upright on a table or other flat surface.

The mobile wagering game machine 800 includes several input/output devices. In particular, the mobile wagering game machine 800 includes buttons 820, audio jack 808, speaker 814, display 816, biometric device 806, wireless transmission devices (e.g., wireless communication units 812 and 824), microphone 818, and card reader 822. Additionally, the mobile wagering game machine can include tilt, orientation, ambient light, or other environmental sensors.

In some embodiments, the mobile wagering game machine 800 uses the biometric device 806 for authenticating players, whereas it uses the display 816 and the speaker 814 for presenting wagering game results and other information (e.g., credits, progressive jackpots, etc.). The mobile wagering game machine 800 can also present audio through the audio jack 808 or through a wireless link such as Bluetooth.

In some embodiments, the wireless communication unit 812 can include infrared wireless communications technology for receiving wagering game content while docked in a wager gaming station. The wireless communication unit 824 can include an 802.11G transceiver for connecting to and exchanging information with wireless access points. The wireless communication unit 824 can include a Bluetooth transceiver for exchanging information with other Bluetooth enabled devices.

In some embodiments, the mobile wagering game machine 800 is constructed from damage resistant materials, such as polymer plastics. Portions of the mobile wagering game machine 800 can be constructed from non-porous plastics which exhibit antimicrobial qualities. Also, the mobile wagering game machine 800 can be liquid resistant for easy cleaning and sanitization.

In some embodiments, the mobile wagering game machine 800 can also include an input/output ("I/O") port 830 for connecting directly to another device, such as to a peripheral device, a secondary mobile machine, etc. Furthermore, any component of the mobile wagering game machine 800 can include hardware, firmware, and/or machine-readable media including instructions for performing the operations described herein.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating a gaming system configured to provide one or more casino wagering games and wagering game results associated with the one or more casino wagering games, said method comprising:

detecting, by the gaming system, wagering game events for the one or more casino wagering games, wherein the one or more casino wagering games are presented by a wagering game application;

determining, by the gaming system, a subscription level associated with a second application, wherein the subscription level indicates access to at least a portion of the wagering game events associated with a wagering game player account;

generating targeted content different from the wagering game events, wherein the targeted content is targeted to the wagering game player account based on the portion of the wagering game events; and providing the targeted content to the second application for presentation via a wagering game machine associated with the wagering game player account.

2. The method of claim 1, wherein the providing the targeted content to the second application comprises:

detecting additional data from the second application; and negotiating a priority order for presenting the targeted content for the second application and wagering game content for the wagering game application via the wagering game machine.

3. The method of claim 1, wherein the subscription level is one of a plurality of different subscription levels that correspond to different types of data, and wherein the determining the subscription level associated with the second application comprises:

determining that the subscription level indicates access to one of the types of data; and selecting a portion of the data that corresponds to the one of the types of the data.

4. The method of claim 3, wherein the one of the types of the data comprises one or more of data about occurrence of the portion of the wagering game events, data about the at least the portion of the wagering game results, data about a combination of game symbols that appear for the wagering game events, data about a type of the one or more casino wagering games, data about statistics of a wagering game session, data about player activity, and data about a player preference for the one or more casino wagering games.

5. The method of claim 1, wherein the providing the target content comprises providing a targeted advertisement based on the portions of the wagering game events.

6. The method of claim 1 further comprising:

determining a degree of access to the wagering game events related to the subscription level;

determining that the degree of access to the data corresponds to the at least the portion of the wagering game events; and providing, via the service, access to the at least the wagering game events.

7. A gaming system comprising:

one or more processors;

a wagering game result generator configured to generate random wagering game results for one or more casino wagering games; and one or more memory storage devices configured to store instructions, which when executed by at least one of the one or more processors, cause the gaming system to, obtain wagering game data from a first application, wherein the wagering game data comprises at least a portion of the random wagering game results;

determine a subscription level associated with a second application, wherein the subscription level indicates access to a portion of the wagering game data associated with a wagering game player account;

generate targeted content different from the wagering game data, wherein the targeted content is targeted to the wagering game player account based on the portion of the wagering game data, and provide, the targeted content to the second application for presentation via a wagering game machine that the wagering game player account is logged into.

8. The gaming system of claim 7, wherein the one or more memory storage devices configured to store the instructions, which when executed by the at least one of the one or more processors, cause the gaming system to generate the targeted content comprise one or more memory storage devices configured to store instructions, which when executed by at least one of the one or more processors, cause the gaming system to:

one or more of publish the targeted content to the second application, provide the second application access to the targeted content, provide to the second application a targeted advertisement based on the portion of the wagering game data, and provide the second application a targeted report on the portion of the wagering game data.

9. The gaming system of claim 7, wherein the one or more memory storage devices configured to store the instructions, which when executed by the at least one of the one or more processors, cause the gaming system to detect the wagering game events comprise one or more memory storage devices configured to store instructions, which when executed by at least one of the one or more processors, cause the gaming system to:

detect at least one of the wagering game events that occurs in at least one of the one of the more casino wagering games presented by the first application, wherein the at least one of the one of the more casino wagering games is played by the wagering game player account; and store wagering game data that corresponds to the at least one of the wagering game events.

10. The gaming system of claim 7, wherein the subscription level is one of a plurality of different subscription levels that correspond to different types of data, and wherein the one or more memory storage devices configured to store the instructions, which when executed by at least one of the one or more processors, cause the gaming system to determine the subscription level associated with the second application comprise one or more memory storage devices configured to store instructions, which when executed by at least one of the one or more processors, cause the gaming system to:

determine that the subscription level indicates access to one of the types of data; and select a portion of the data that corresponds to the one of the types of the data.

11. The apparatus of claim 10, wherein the one of the types of the wagering game data comprises one or more of data about occurrence of a wagering game event, data about a wagering game result for a wagering game event, data about a combination of game symbols that appear for a wagering game event, data about a type of a wagering game for which a wagering game event occurred, data about statistics of a wagering game session in which a wagering game event occurred, data about player activity related to a wagering game event, and data about a player preference for a wagering game associated with a wagering game event.

12. A gaming system comprising:

one or more processors;

a wagering game result generator configured to generate one or more random wagering game results for one or more casino wagering games; and one or more memory storage devices configured to store instructions, which when executed by at least one of the one or more processors, cause the gaming system to perform operations to:

detect wagering game statistics from a wagering game application for at least a portion of the one or more casino wagering games presented by the first application in one or more wagering game sessions associated with a wagering game player account, wherein the wagering game statistics comprise at least a portion of the random wagering game results that are associated with the wagering game player account;

in response to detecting the wagering game statistics, determine a subscription level associated with a second application, wherein the subscription level is one of a plurality of different subscription levels that correspond to a plurality of different services, wherein the subscription level indicates one of a plurality of degrees of detail of the wagering game statistics, wherein each of the plurality of degrees of detail are associated with different ones of the plurality of subscription levels;

generate targeted content, wherein the targeted content is targeted to the wagering game player account based on the one of the plurality of degrees of detail of the wagering game statistics; and provide to the second application one of the plurality of different services that corresponds to the subscription level, wherein the one of the plurality of different services includes the targeted content.

13. The system of claim 12, wherein the one or more memory storage devices configured to store the instructions, which when executed by the at least one of the one or more processors, cause the gaming system to perform the operation to detect the wagering game statistics from the wagering game application comprise one or more memory storage devices configured to store instructions, which when executed by at least one of the one or more processors, cause the gaming system to perform operations to:

detect wagering game events that occur in a wagering game presented by the wagering game application; and obtain the wagering game statistics that correspond to the wagering game events.

14. The gaming system of claim 13, wherein the one or more memory storage devices are configured to store instructions, which when executed by at least one of the one or more processors, cause the gaming system to perform operations to:

determine that the subscription level indicates access to a type of data;

determine that wagering game statistics about the wagering game events correspond to the type of data;

select the wagering game statistics from a data store that contains a plurality of different types of data about the wagering game event;

generate the targeted content using the wagering game statistics; and provide the targeted content via the one of the plurality of different services.

15. The gaming system of claim 14, wherein the type of the data that corresponds to the wagering game events comprises one or more of data about occurrence of the wagering game events, data about a wagering game result for the wagering game events, data about a combination of game symbols that appear for the wagering game events, data about a type of a wagering game for which the wagering game events occurred, data about statistics of a wagering game session in which the wagering game events occurred, data about player activity related to the wagering game events, and data about a player preference for a wagering game associated with the wagering game events.

16. The gaming system of claim 12, wherein the one or more memory storage devices configured to store the instructions, which when executed by the at least one of the one or more processors, cause the gaming system to perform the operation to provide to the second application the one of the plurality of different services that corresponds to the subscription level comprise one or more memory storage devices configured to store instructions, which when executed by at least one of the one or more processors, cause the gaming system to perform operations to, via the one of the plurality of different services one or more of publish the wagering game statistics to the second application, provide the second application access to the wagering game statistics, provide to the second application an advertisement based on the wagering game statistics, and provide the second application a report on the wagering game statistics.

17. The gaming system of claim 11 further comprising one or more memory storage devices configured to store instructions, which when executed by at least one of the one or more processors, cause the gaming system to perform operations to:

determine that the subscription level associated with the second application provides a degree of access to data related to an event; and providing, via the one of the plurality of different services, access to a portion of the data that corresponds to the degree of access to the data.

18. One or more non-transitory, machine-readable storage media having instructions stored thereon, which when executed by a set of one or more processors of a gaming system cause the set of one or more processors to perform operations comprising:

obtaining wagering game data for a casino wagering game presented by a wagering game application in at least one of a plurality of wagering game sessions associated with a wagering game player account, wherein the wagering game data comprises wagering game results generated by the gaming system;

determining a subscription level associated with a second application, wherein the subscription level is one of a plurality of subscription levels that correspond to a plurality of tiers of a service;

determining a level of detail associated with one of the tiers of the service that corresponds to the subscription level;

accessing the level of detail for the wagering game data that is associated with the wagering game player account based on the determining the level of detail associated with the one of the tiers of the service;

generating content that is targeted to the wagering game player account based on the level of detail for the wagering game data; and providing to the second application one of the plurality of tiers of the service that corresponds to the subscription level, wherein the one of the plurality of tiers of service provides the targeted content for presentation via a wagering game machine associated with the wagering game player account.

19. The one or more non-transitory, machine-readable storage media of claim 18, wherein the operation of obtaining the wagering game data from the wagering game application includes operations comprising:

detecting a wagering game event that occurs in the casino wagering game presented by the wagering game application; and obtaining data that corresponds to the wagering game event.

20. The one or more non-transitory, machine-readable storage media of claim 18, said operations further comprising:

determining that the subscription level indicates access to a type of data;

determining that the data from the wagering game event corresponds to the type of data;

selecting the data from a data store that contains a plurality of different types of data;

generating the content using the data; and providing the content via the one of the plurality of tiers of the service.

21. The one or more non-transitory, machine-readable storage media of claim 20, wherein the type of data comprises one or more of data about occurrence of a wagering game event, data about at least one of the wagering game results, data about a combination of game symbols that appear for a wagering game event, data about a type of the casino wagering game, data about statistics of the at least one of the wagering game sessions, data about player activity, and data about a player preference for a wagering game.

22. The one or more non-transitory, machine-readable storage media of claim 18, wherein the operation of providing to the second application the one of the plurality of the tiers of the service that corresponds to the subscription level includes operations comprising, via the one of the plurality of the tiers of the service, one or more of publishing the wagering game data to the second application, providing the second application access to the wagering game data, providing to the second application an advertisement based on the wagering game data, and providing the second application a report on the wagering game data.

23. The one or more non-transitory, machine-readable storage media of claim 18 further comprising one or more memory storage devices configured to store instructions, which when executed by at least one of the one or more processors, cause the set of one or more processors to perform operations to:

determine that the subscription level associated with the second application provides a degree of access to the data; and providing, via the one of the plurality of different services, access to a portion of the data that corresponds to the degree of access to the data.

24. A gaming apparatus comprising:

means for obtaining wagering game data associated with first content presented by a first application via a wagering game machine associated with a wagering game player account, wherein the wagering game data comprises wagering game results generated by the gaming apparatus;

means for receiving a request by a second application for second content;

means for determining that the second application is subscribed to a first service from a plurality of services, wherein the first service provides access to a portion of the wagering game data associated with the wagering game player account;

means for generating the second content using the portion of the wagering game data, wherein the second content is targeted to the wagering game player account; and means for providing the second content to the second application.

25. The apparatus of claim 24, wherein the means for generating the second content using the portion of the wagering game data that corresponds to the first service comprises:

means for selecting from the wagering game data the portion of the wagering game data authorized by one of differing degrees of access; and means for generating, as the second content, an advertisement that is targeted to the wagering game player account based on the portion of the wagering game data.

26. The apparatus of claim 24, wherein the means for obtaining the wagering game data associated with the first content presented by the first application via the wagering game machine comprises means for obtaining a first type of wagering game data and a second type of wagering game data; wherein the first type of wagering game data corresponds to the first service and wherein the second type of wagering game data corresponds to a second service from the plurality of different services; and wherein the means for generating the second content using the portion of the wagering game data that corresponds to the first service comprises generating the second content using the first type of wagering game data.

* * * * *